United States Patent [19]

Nosaki et al.

[11] Patent Number: 4,469,435

[45] Date of Patent: Sep. 4, 1984

[54] COMBINATION CHARGING/CLEANING ARRANGEMENT FOR COPIER

[75] Inventors: Takefumi Nosaki; Masahiro Hosoya, both of Yokohama, Japan

[73] Assignee: Tokyo Shibaura Kabushiki Kaisha, Kawasaki, Japan

[21] Appl. No.: 418,834

[22] Filed: Sep. 16, 1982

[30] Foreign Application Priority Data

Oct. 28, 1981 [JP] Japan ..... 56-172276

[51] Int. Cl.[3] ..... G03G 15/08

[52] U.S. Cl. ..... 355/15; 355/3 DD; 355/14 D; 15/1.5 R; 118/652

[58] Field of Search ..... 355/15, 3 DD, 14 D; 15/1.5 R, 256.52; 118/652, 658

[56] References Cited

U.S. PATENT DOCUMENTS

| | | | |
|---|---|---|---|
| 3,780,391 | 12/1973 | Leenhouts | 355/15 X |
| 3,917,397 | 11/1975 | Tanaka et al. | 355/15 |
| 4,123,154 | 10/1978 | Fisher | 355/15 |
| 4,361,922 | 12/1982 | Karal | 355/15 X |

FOREIGN PATENT DOCUMENTS

| | | |
|---|---|---|
| 2101904 | 10/1971 | Fed. Rep. of Germany . |
| 2156117 | 5/1972 | Fed. Rep. of Germany . |
| 2218918 | 10/1973 | Fed. Rep. of Germany . |
| 2555854 | 9/1976 | Fed. Rep. of Germany . |

*Primary Examiner*—A. C. Prescott

*Attorney, Agent, or Firm*—Cushman, Darby & Cushman

[57] ABSTRACT

An electrostatic copying apparatus comprises a charging/cleaning device which has both a charging function for charging a photosensitive layer and a cleaning function for removing a developer remaining on the photosensitive layer. The charging/cleaning device includes a first common rotatable roller having an electrical conductive contactor on the outer periphery thereof, a voltage applying mechanism for applying a voltage between furs of the contactor and a photosensitive drum. The furs applied with the voltage charge the photosensitive layer and electrostatically attract the developer remaining on the photosensitive layer to clean thereof. The charging/cleaning device further includes a recovering mechanism for recovering the developer attracted to the furs therefrom.

10 Claims, 6 Drawing Figures

COMBINATION CHARGING/CLEANING ARRANGEMENT FOR COPIER

BACKGROUND OF THE INVENTION

The present invention relates to an electrostatic copying apparatus having a photosensitive body and, more particularly, to an electrostatic copying apparatus which comprises means for charging a photosensitive body and means for cleaning the photosensitive body.

A contact type charging device for charging a photosensitive drum and a cleaning device of electric cleaning type employing a fur brush for cleaning the surface of the photosensitive drum have recently been developed in the technical field of an electrostatic copying apparatus. However, these devices have flowed currents to the photosensitive drum and have frictioned the surface of the photosensitive drum. Therefore, in case that both the charging device and the cleaning device have been used in the electrostatic copying apparatus, the steps of flowing currents to the photosensitive drum and frictioning the surface of the drum have been respectively carried out twice in one copying process in the copying apparatus.

Accordingly, the photosensitive drum has rapidly fatigued, thereby shortening its lifetime. Further, a charging device in the electrostatic copying apparatus has always been contacted with the photosensitive drum, and a developer has thus constantly adhered to the charging device. On the other hand, the developer has also been adhered to a fur brush in the cleaning device. Therefore, both the charging device and the cleaning device should have respectively required exclusive cleaning units. Thus, both the conventional charging device and the cleaning device have become complicated structure, and yet should have disadvantageously necessitated the same or equivalent components in duplicate in the same electrostatic copying apparatus as its drawbacks.

SUMMARY OF THE INVENTION

It is an object of the present invention to provide a new and improved electrostatic copying apparatus which is capable of prolonging the lifetime of a photosensitive body and which is simple in structure.

According to an aspect of the present invention, there is provided an electrostatic copying apparatus which comprises; a photosensitive body rotated along one direction; charging means for charging the surface of the photosensitive body; and cleaning means for cleaning the surface of the photosensitive member by removing a developer remaining on the surface of the photosensitive body therefrom, the charging means and cleaning means including a first common rotatable roller having a contactor with an electric conductivity on the outer periphery thereof, said contactor having a number of pliable furs implanted on the first common rotatable roller and being in contact with the surface of the photosensitive body; first driving means for rotating the first roller; voltage applying means for applying a voltage between the furs and the photosensitive body, the furs applied with the voltage being charging the surface of the photosensitive body and electrostatically attracting the developer remaining on the surface of the photosensitive body to clean the surface of the photosensitive body; and recovering means for recovering the developer attracted to the furs therefrom.

DETAILED DESCRIPTION OF THE PREFERRED EMBODIMENT

One embodiment of an electrostatic copying apparatus according to the present invention will now be described in more detail with reference to the accompanying FIGS. 1 to 5.

Figure 1:
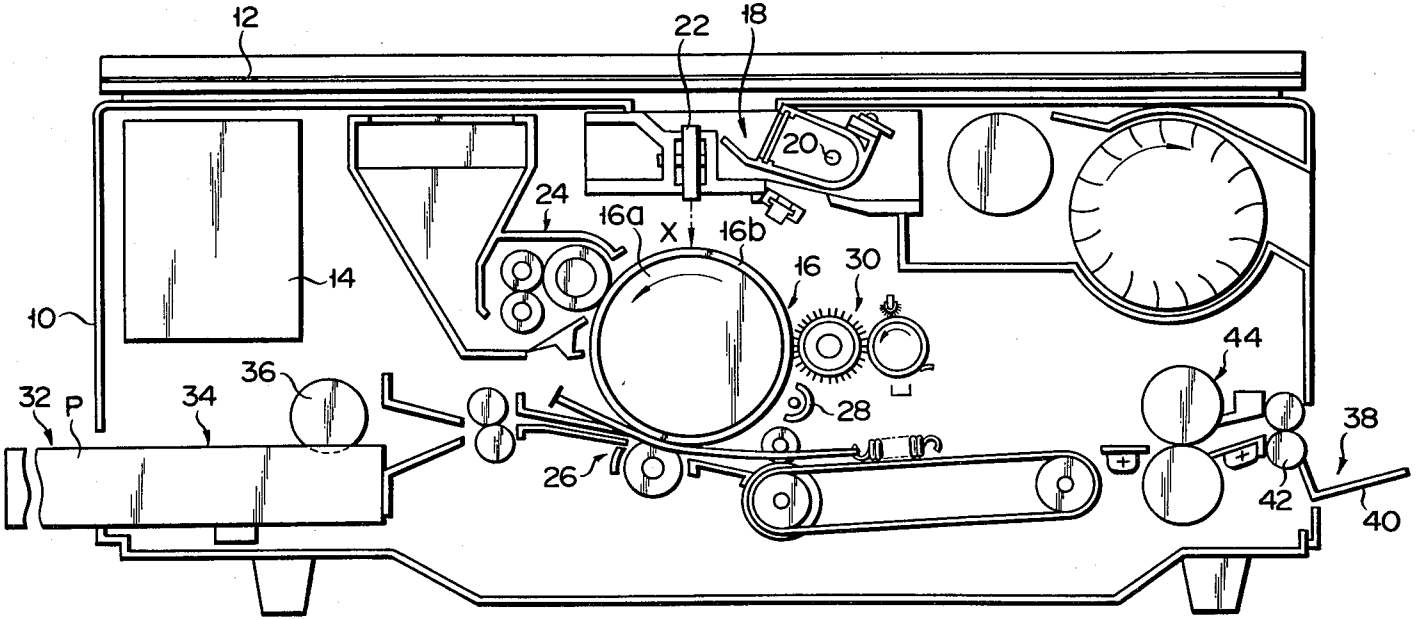
FIG. 1 is a front view schematically showing one embodiment of an electrostatic copying apparatus according to the present invention.
Figure 2:
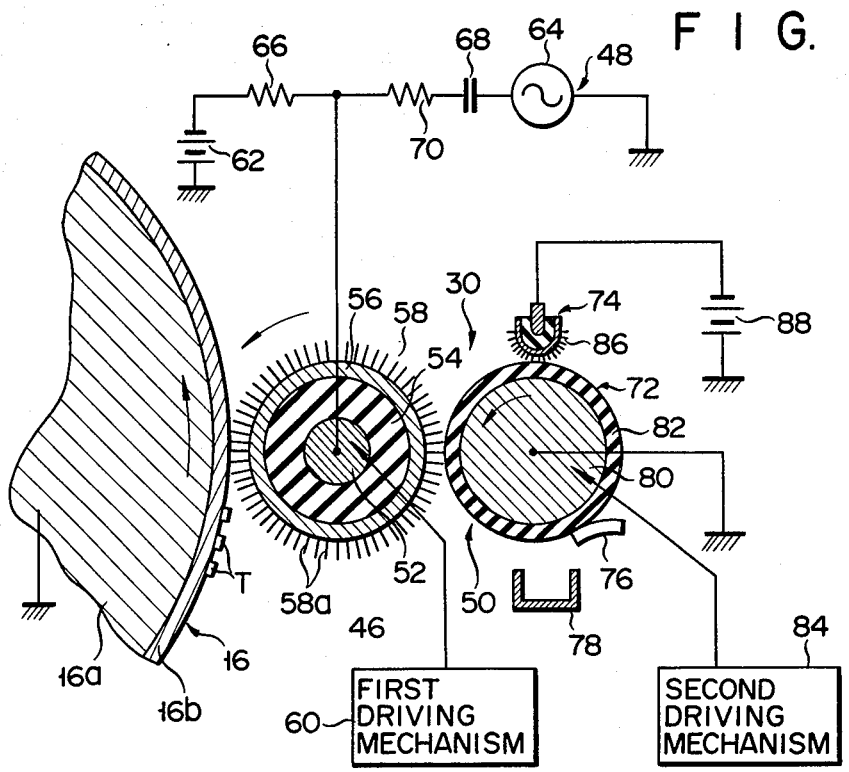
FIG. 2 is a sectional view showing partly in an enlargement a charging/cleaning device shown in FIG. 1.

In FIG. 1, reference numeral 10 designates a housing of the electrostatic copying apparatus. On the upper surface of the housing 10 is provided an original rest 12 which is reciprocatedly moved by a driving mechanism 14. At substantially center in the housing 10 is rotatably supported a photosensitive drum 16. This photosensitive drum 16 includes a drum-shaped base **16*a* connected to a ground, and a photosensitive layer 16*b* laid on the outer peripheral surface of the base 16*a* and including negatively charging polarity. This photosensitive drum 16 is rotated along a counter-clockwise direction by the driving mechanism 14**.

In the housing 10 above the photosensitive drum 16 is arranged an exposure device 18. This exposure device 18 includes an exposure lamp 20 which illuminates an original placed on the original rest 12, and a light converging transmission device 22 which converges the reflected light from the original to a predetermined exposure section X on the photosensitive layer **16*b* to guide the reflected light thereto. Around the photosensitive drum 10 are arranged in the rotating direction of the drum 10 sequentially from the exposure section X, a developing device 24, a transfer/separating device 26, a discharging device 28, and a charging/cleaning device 30, as will be described in more detail, having both a charging function for charging the photosensitive layer 16*b* and a cleaning function for removing a developer remaining on the photosensitive layer 16*b***.

At one side of the housing 10 is provided a sheet feeding mechanism 32. The sheet feeding mechanism 32 includes a cassette 34 detachable from the housing 10 containing a pile of copy sheets P therein and a takeup roller 36 for taking up the copy sheets contained in the cassette 34 one by one. On the other hand, at the other side of the housing 10 is provided a sheet exhausting mechanism 38. This sheet exhausting mechanism 38 includes an exhausted sheet tray 40 detachable from the housing 10, and a pair of sheet exhausting rollers 42 for exhausting the copy sheets P to the tray 40. Immediately before the roller 42 is provided a fixing device 44.

The charging/cleaning device 30 described above includes, as shown in more detail in FIG. 2, a charging/cleaning roller 46 slidably contacted with the photosensitive layer **16*b* of the photosensitive drum 16 for charging in contact the photosensitive layer 16*b* and removing the developer remaining on the photosensitive layer 16*b* therefrom, a voltage applying mechanism 48 for applying a voltage to the charging/cleaning roller 46, and a recovery mechanism 50 for recovering the developer removed by the charging/cleaning roller 46 from the charging/cleaning roller 46**.

This charging/cleaning roller 46 includes a first metallic roller 52 as a core, an elastic layer 54 provided in a predetermined thickness on the outer periphery of the first metallic roller 52, an electrode layer 56 attached to the outer periphery of the elastic layer 54, and a contactor 58 provided over the circumferential surface of the electrode layer 56. This charging/cleaning roller 46 is rotatably supported. This first metallic roller 52 is formed of metal having an electric conductivity. The elastic layer 54 has a predetermined elasticity and is formed of a conductive sponge. The electric resistivity of the elastic layer 54 is set to lower than $10^5\Omega$.cm. The electrode layer 56 is formed of a conductive material having 0.5 to 5 mm of thickness. The electrical resistivity of this conductive material is $10^7$ to $10^9\Omega$.cm, and is set in this embodiment to $10^8\Omega$.cm.

The contactor 58 is formed of pile fiber (REC-B, trade name), and this pile fiber is mixed with carbon, and is set to $10^7$ to $10^9\Omega$/cm of electric resistance per unit length, and is set in this embodiment, to $10^9\Omega$/cm. This pile fiber includes a basic cloth and furs **58*a* having pliable property and uniformly implanted in a density of 50 to 70 pieces/mm$^2$ on the basic cloth. Each fur 58*a* has a length of 1 to 10 mm, and has, in this embodiment, 1.5 mm, and a thickness of 1 to 10 d (denier), and is set, in this embodiment, to 3 d. The contactor 58 is adhered to the outer periphery of the electrode layer 56 with a conductive adhesive having the same material and the same electric resistance as the electrode layer 56. The charging/cleaning roller 46 thus constructed is arranged on the photosensitive layer 16*b* to be uniformly and lightly contacted with the layer 16*b* in a predetermined nip width N in a range, for example, of 2 to 6 mm. This charging/cleaning roller 46 is rotated along a counterclockwise direction by a first driving mechanism 60**.

The first driving mechanism 60 rotates the charging/cleaning roller 46 at the peripheral speed difference of 10 to 150 mm/sec. 100 mm/sec. in this embodiment, from the photosensitive drum 16. In other words, when the charging/cleaning roller 46 rotates in the same rotating direction as that of the photosensitive drum 16, the former rotates the latter in reverse direction to the above in the nip section. Accordingly, the photosensitive drum 16 and the charging/cleaning roller 46 may respectively rotate at the peripheral speed of 50 mm/sec, with the result that the difference of the peripheral speeds between the charging/cleaning roller 46 and the photosensitive drum 16 becomes 100 mm/sec., in this case. On the other hand, when the charging/cleaning roller 46 rotates along the reverse rotating direction to the rotating direction of the photosensitive drum 16, the former rotates in the same direction as the latter in the nip section. Accordingly, the photosensitive drum 16 and the charging/cleaning roller 46 may, for example, rotate respectively at the peripheral speed of 50 mm/sec. and 130 mm/sec., with the result that the difference of the peripheral speeds between the charging/cleaning roller 46 and the photosensitive drum 16 becomes 80 mm/sec., in this case.

The voltage applying mechanism 48 described above includes a DC power source 62 of 500 to 1,000 V, and an AC power source 64 of 400 to 600 V (RMSV), 400 to 1,000 Hz. The positive electrode of the DC power source 62 is grounded, and the negative electrode thereof is connected through a first resistor 66 to the first metallic roller 52 of the charging/cleaning roller 46. On the other hand, the one output terminal of the AC power source 64 is grounded, and the other output terminal is connected through a capacitor 68 and a second resistor 70 to the first metallic roller 52. In other words, to the contactor 58 are superposed to be applied both the AC and DC voltages.

The recovery mechanism 50 described above includes a collecting roller 72 rotatably provided in contact with the contactor 58 of the charging/cleaning roller 46, a contact charger 74 for charging the surface of the collecting roller 72 in contact with the surface of the roller 72, a scraper 76 provided in contact with the surface of the collecting roller 72 for scraping off the developer collected on the surface of the collecting roller 72, and a container 78 provided under the scraper 76 for containing the developer thus scraped off by the scraper 76. The collecting roller 72 is provided with a second metallic roller 80 grounded as a core, and an insulating layer 82 laid on over the outer peripheral surface of the second metallic roller 80. The thickness of the insulating layer 82 is set to 20 to 100 μm, 20 μm in this embodiment. This collecting roller 72 is so arranged as to contact in the nip width of 2 to 6 mm, 4 mm in this embodiment, with the contactor 58 of the charging/cleaning roller 46.

This collecting roller 72 is rotated along the counterclockwise direction by a second driving mechanism 84. This second driving mechanism 84 rotates the collecting roller 72 so that the difference between the peripheral speeds of the collecting roller 72 and the charging/cleaning roller 46 becomes 30 to 200 mm/sec, 100 mm/sec in this embodiment. The contact charger 74 is formed in the same structure as that of the charging/cleaning roller 46 described above except that the contact charger 74 is provided fixedly. The furs 86 of the contact charger 74 are set so that the nip width becomes longer than 5 mm with the collecting roller 72. The negative electrode of the other DC power source 88 is connected to the contact charger 74. The positive electrode of the DC power source 88 is grounded. This DC power source 88 applies a DC voltage to the collecting roller 72 so that the surface of the collecting roller 72 has the surface potential of 1,000 to 2,500 V, 2,000 V in this embodiment in charging.

The operation of the electrostatic copying apparatus thus constructed as described above will now be described in more detail.

A voltage is applied by the voltage applying mechanism 48 to the charging/cleaning roller 46 of the charging/cleaning device 30, and the photosensitive layer **16*b* of the photosensitive drum 16 is uniformly charged with the surface potential of −400 to −500 V. The photosensitive layer 16*b* thus charged is exposed in response to the image of an original to the exposure section X, and an electrostatic latent image is formed on the photosensitive layer 16b. This electrostatic latent image is visualized via a developer by the developing device 24. The image thus visualized is transferred by the transfer device 26 onto a copy sheet P, and the transferred image on the copy sheet P is fixed by the fixing device 44. In this manner, the copy sheet P thus fixed is exhausted by the exhausting roller 42 onto the exhausted sheet tray 40**.

On the other hand, the photosensitive layer 16b thus transferred is electrostatically eliminated by the discharging device 28, and is then reached to the charging/cleaning device 30. In this charging/cleaning device 30, the developer T not taking part in the developing operation and remaining on the photosensitive layer 16b is removed from the surface of the photosensitive layer 16b. In other words, the remaining developer T on the photosensitive layer 16b is interposed among the furs 58a of the charging/cleaning roller 46, and the respective furs 58a is charged by the voltage applying mechanism 48 to have the reverse polarity to the charging polarity of the developer T at the potential higher than the surface potential of the photosensitive layer 16b. Therefore, the developer T is removed from the surface of the photosensitive layer 16b and is adhered electrostatically among the furs 58a. In this manner, the photosensitive layer 16b is cleaned by the charging/cleaning device 30.

The developer T adhered electrostatically among the furs 58a of the charging/cleaning roller 46 is fed to the nip section of the collecting roller 72 upon rotating of the roller 46. In this nip section, the collecting roller 72 has a surface potential higher than that of the charging/cleaning roller 46 and is charged in the same polarity, and the developer T adhered electrostatically among the furs 58a is accordingly electrostatically attracted to the surface of the collecting roller 72. In this manner, the developer T in the charging/cleaning roller 46 is recovered by the collecting roller 72.

The developer T thus collected on the surface of the collecting roller 72 is fed to the section contacted with the scraper 76 upon rotating of the collecting roller 72. The developer T is scraped off by the scraper 76 from the surface of the collecting roller 72, and the collecting roller 72 is thus cleaned. The developer T thus scraped off is contained in the container 78, and a series of the cleaning operation, i.e., the developer removing operation has thus been completed.

According to one embodiment of the electrostatic copying apparatus in accordance with the present invention as described above, the photosensitive layer 16b is charged, and is simultaneously cleaned by the charging/cleaning device 30. Therefore, the steps of flowing currents to the photosensitive layer 16b and frictioning the surface of the photosensitive layer 16b can be merely performed once in one copying process. In this manner, the fatigue of the photosensitive layer 16b can be reduced, the lifetime of the photosensitive drum 16 can be largely improved, the structure of the copying process apparatus can be simplified, its cost can be reduced, and the controlling steps can be decreased, thereby performing the space-saving of the electrostatic copying apparatus of the present invention.

Figure 3:
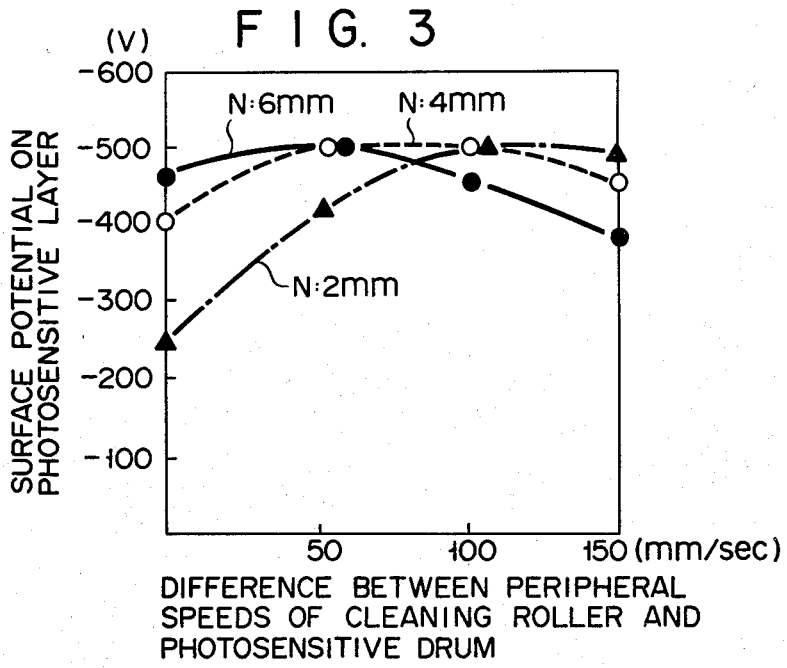
FIG. 3 is a graphical diagram showing the relationship between the difference between the peripheral speeds of the charging/cleaning roller and the photosensitive drum, and the surface potential on the photosensitive drum in the embodiment of the present invention.
Figure 4:
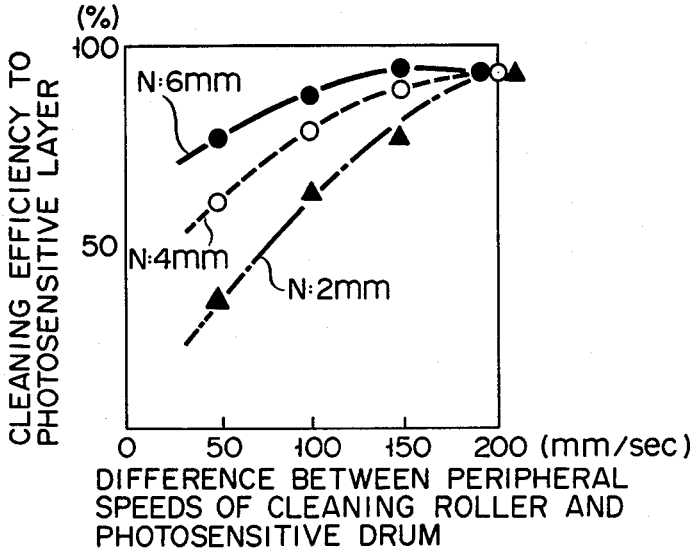
FIG. 4 is a graphical diagram showing the relationship between the difference between the peripheral speeds of the cleaning roller and the photosensitive drum, and the cleaning efficiency to a photosensitive layer.
Figure 5:
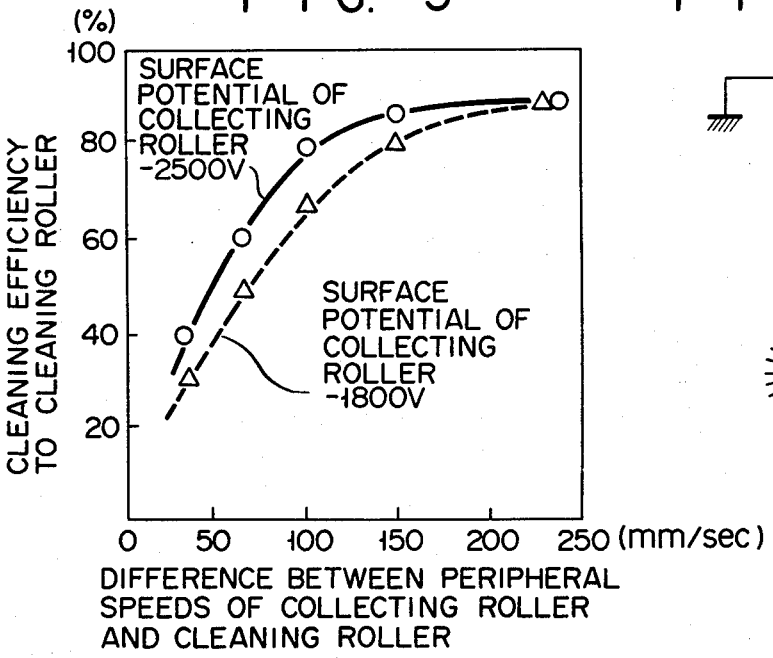
FIG. 5 is a graphical diagram showing the relationship between the difference between the peripheral speeds of the recovery roller and the charging/cleaning roller, and the cleaning efficiency to the cleaning roller.

The results of the experiments in case of employing the charging/cleaning device 30 of the embodiment of the electrostatic copying apparatus according to the present invention will now be respectively indicated in FIGS. 3 to 5. More particularly, FIG. 3 is a graphical diagram showing the relationship between the difference between the peripheral speeds of the charging/cleaning roller 46 and the photosensitive drum 16, and the surface potential on the photosensitive layer 16b with the nip width N plotted as parameters by varying to 2 mm, 4 mm, 6 mm. FIG. 4 is a graphical diagram showing the relationship between the difference between the peripheral speeds of the charging/cleaning roller 46 and the photosensitive drum 16, and the cleaning efficiency to the photosensitive drum 16 with the nip width N plotted as parameters by varying to 2 mm, 4 mm, 6 mm. FIG. 5 is a graphical diagram showing the relationship between the difference between the peripheral speeds of the collecting roller 72 and the charging/cleaning roller 46, and the cleaning efficiency to the charging/cleaning roller 46 with the surface potential of the collecting roller 72 plotted as parameters.

As evident from FIGS. 3 to 5 as described above, according to the charging/cleaning device 30 of the embodiment of the electrostatic copying machine in accordance with the present invention, it will be understood from the foregoing description that both the charging operation and the cleaning operation can be sufficiently performed.

Figure 6:
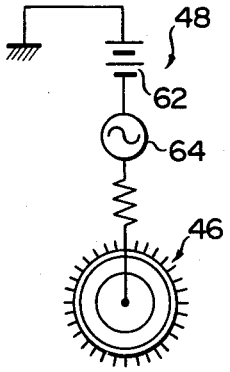
FIG. 6 is a front view showing one modification of the voltage applying means used in the electrostatic copying apparatus according to the invention.

The present invention is not limited to the particular embodiment described above. Various other changes and modifications may be made within the spirit and scope of the present invention. For example, as designated as one modification of the voltage applying means in FIG. 6, the voltage applying means 48 may be constructed that the DC power source 62 and the AC power source 64 is connected in series with each other. In other words, the DC power source 62 and the AC power source 64 may not always be connected in parallel with each other as disclosed with respect to the above-described embodiment of the present invention, but may be constructed so that both the DC voltage and the AC voltage are superposed to be applied to the charging/cleaning roller 46.

What we claimed is:

1. An electrostatic copying apparatus comprising:

a photosensitive body rotatable in one direction and having a chargeable surface;

first charging means for charging said surface;

cleaning means for cleaning said surface by recovering any developer remaining thereon after a copying operation, said cleaning means and first charging means together including a first common rotatable roller, said first common rotatable roller including an electrically resistive contactor having a number of pliable hairs implanted on the outer periphery of the first common rotatable roller, said hairs being in contact with said surface;

first driving means for rotating the first common rotatable roller;

voltage applying means for applying voltage between the first common rotatable roller and said photosensitive body, said voltage applying means including D.C. and A.C. power sources for applying D.C. and A.C. voltages between the hairs and said photosensitive body, the hairs applying electrostatic charge to said surface and electrostatically attracting the developer remaining on said surface to clean it; and recovering means for recovering the developer attached to the cleaning means, said recovering means including a recovery roller having a dielectric layer which is formed on the outer peripheral surface thereof and is in contact with said hairs, and second charging means for charging the dielectric layer to attract the developer held between the hairs of the first common rotatable roller to the recovery roller of the recovering means.

2. The electrostatic copying apparatus according to claim 1, wherein said first roller includes:

a conductive core formed in a roller shape;

a conductive elastic member formed on the outer periphery of said core; and an electrode layer formed of the outer periphery of said elastic member, said contactor is attached to the outer periphery of said electrode layer, and said voltage applying means is connected to said core.

3. The electrostatic copying apparatus according to claim 2, wherein said contactor is secured to the outer periphery of said electrode layer through a conductive adhesive.

4. The electrostatic copying apparatus according to claim 3, wherein said conductive adhesive is made of the same material which is used by the electrode layer and has the same electrical resistivity as that of the electrode layer.

5. The electrostatic copying apparatus according to claim 1, wherein said DC power source is connected in series with said AC power source.

6. The electrostatic copying apparatus according to claim 1, wherein said DC power source is connected in parallel with said AC power source.

7. The electrostatic copying apparatus according to claim 1, wherein said recovery means includes:

second roller rotatable with an insulating layer on the outer periphery thereof;

second driving means for rotating said second roller;

second charging means for charging the insulating layer of said second roller, a developer attracted among the piles being electrostatically attracted onto the insulating layer therefrom; and scraping means for scraping off the developer attracted to the insulating layer of said second roller.

8. The electrostatic copying apparatus according to claim 7, wherein said scraping means includes:

a scraping plate provided in contact with said insulating layer for removing the developer attached thereto upon rotating of said second roller from the insulating layer; and a container provided under said scraping plate for receiving the developer removed by scraping off therefrom.

9. The electrostatic copying apparatus according to claim 7, wherein said second charging means includes:

a contactor having electric conductivity and provided in contact with said insulating layer with a number of furs implanted thereon; and second voltage applying means for applying a voltage to said furs.

10. The electrostatic copying apparatus according to claim 9, wherein said second voltage applying means includes a DC power source.

* * * * *